United States Patent [19]

Maier et al.

[11] Patent Number: 4,822,244

[45] Date of Patent: Apr. 18, 1989

[54] TOBI

[75] Inventors: Mark S. Maier, North Palm Beach; Jesse Eng, Jupiter, both of Fla.

[73] Assignee: United Technologies Corporation, Hartford, Conn.

[21] Appl. No.: 108,528

[22] Filed: Oct. 15, 1987

[51] Int. Cl.[4] ..... F01D 5/08

[52] U.S. Cl. ..... 416/95; 415/115

[58] Field of Search ..... 416/95, 144; 415/115, 415/180

[56] References Cited

U.S. PATENT DOCUMENTS

| | | | |
|---|---|---|---|
| 3,565,545 | 2/1971 | Bobo et al. | 415/115 X |
| 3,663,118 | 5/1972 | Johnson | 416/95 X |
| 3,768,921 | 10/1973 | Brown et al. | 415/116 |
| 3,936,215 | 2/1976 | Hoff | 415/11.5 |
| 3,989,410 | 11/1976 | Ferrari | 415/115 |
| 4,236,869 | 12/1980 | Laurello | 416/95 |
| 4,425,079 | 1/1984 | Speak et al. | 415/115 X |
| 4,435,123 | 3/1984 | Levine | 416/95 |
| 4,447,190 | 5/1984 | Campbell | 416/95 |
| 4,466,239 | 8/1984 | Napoli et al. | 415/172 A X |
| 4,526,511 | 7/1985 | Levine | 416/95 |
| 4,657,482 | 4/1987 | Neal | 415/176 |
| 4,708,588 | 11/1987 | Schwarz et al. | 415/115 |
| 4,730,978 | 3/1988 | Baran | 415/115 |

FOREIGN PATENT DOCUMENTS

| | | | |
|---|---|---|---|
| 1043718 | 11/1958 | Fed. Rep. of Germany | 416/95 |

*Primary Examiner*—Everette A. Powell, Jr.
*Attorney, Agent, or Firm*—Norman Friedland

[57] ABSTRACT

The performance of a TOBI for a gas turbine engine is improved by providing bypass apertures in the housing of said TOBI for directing a stream of air into the seal sealing the TOBI compartment and bypassing the nozzles of the TOBI to reduce the size of the plume of the TOBI cooling air.

3 Claims, 2 Drawing Sheets

TOBI

This invention was made under a Government contract and the Government has rights herein.

TECHNICAL FIELD

This invention relates to gas turbine engines and more particularly to the tangential on board injector (TOBI) that serves to help cool the turbine and provide the cooling air for the turbine blades.

BACKGROUND ART

The TOBI is a well known device, which may be known by different names, that is utilized to provide cooling air to the turbine of the gas turbine engine. An example of the TOBI is shown in U.S. Pat. No. 4,526,511 granted to R. Levine on July 2, 1985 and assigned to United Technologies Corporation, the assignee common to this patent application, which should be referred to for more details. In particular, the inlet of the TOBI receives air from the compressor or a source of cooling air and passes it through annular spaced nozzles that impart a swirling moment and directs the discharging stream tangentially to the rotating turbine. The velocity, amount and direction of the cooling air is very important as viewed from the effectiveness of its cooling capacity and its effect to the overall engine performance. It is extremely important that only the correct amount of air be utilized as any additional air would be a penalty to the performance of the engine or too little air would result in overheating of the turbine or requiring the temperature of the gas stream to be reduced again impacting engine performance. Hence, ideally the TOBI will optimize the use of turbine cooling air in order to minimize the cooling air temperature.

Essentially, the air discharging from the TOBI is delivered into a cavity just ahead of the turbine. The cavity is typically sealed off by seals (generally labyrinth type) that interface between the rotating and non-rotating structure. Inasmuch as seals have some leakage, the air discharging through the TOBI in heretofore known designs escape from the cavity through the seals resulting in an adverse effect on the performance of the TOBI.

The arrows in FIG. 1 demonstrate the effect the seals have on the plume of the cooling air discharging from the TOBI. As noted, the turbine 10 (partially shown) comprises the disk 14 supporting a plurality of circumferentially spaced blades 16 (one being shown). The inner seal 18 and outer seal 20 define an annular cavity 22 just ahead of the turbine. The TOBI 24 which comprises an annular passageway 26 receives the compressor discharge air and delivers it to the turbine rotor through a plurality of nozzles 28.

The arrows illustrating the plume of the air discharging from the TOBI illustrate graphically the effect the leakage has on the plume and, as noted, is significantly wide.

We have found that we can reduce the plume size and consequently reduce the temperature of the cooling air supplied to the turbine (by virtue of reducing the air pumping effect from the disk) by providing apertures in the TOBI upstream of the nozzles and judiciously sizing and orienting these apertures so as to create tangential jet streams of air that pressurize the cavity in proximity to the seal.

DISCLOSURE OF THE INVENTION

An object of this invention is to provide an improved TOBI for a gas turbine engine.

A still further object of this invention is to improve the performance of a TOBI by providing judiciously located, sized and oriented holes in the TOBI upstream of the air to bypass the TOBI's nozzles and supply the leakage air to the seals in the cavity being fed by the TOBI.

The foregoing and other features and advantages of the present invention will become more apparent from the following description and accompanying drawings.

BEST MODE FOR CARRYING OUT THE INVENTION

Figure 1:
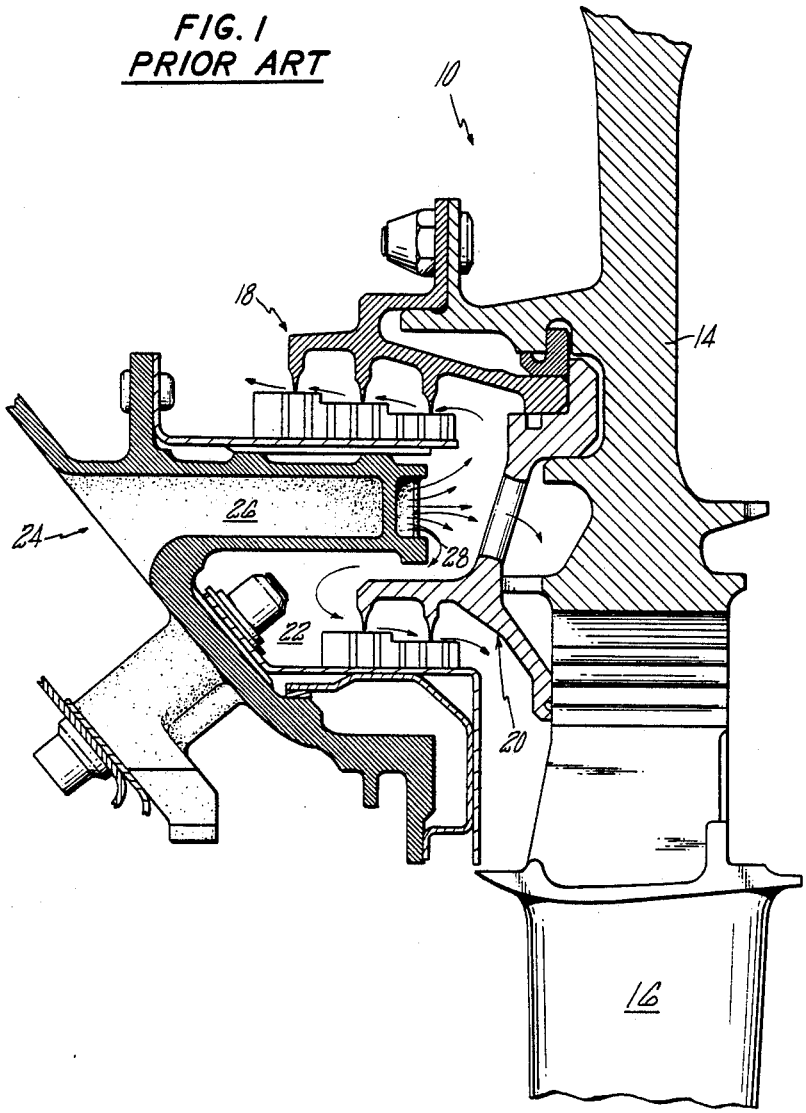
FIG. 1 PRIOR ART
FIG. 1 is a partial view partly in section and partly in elevation showing the TOBI and turbines of a gas turbine engine and illustrating the prior art.
Figure 2:
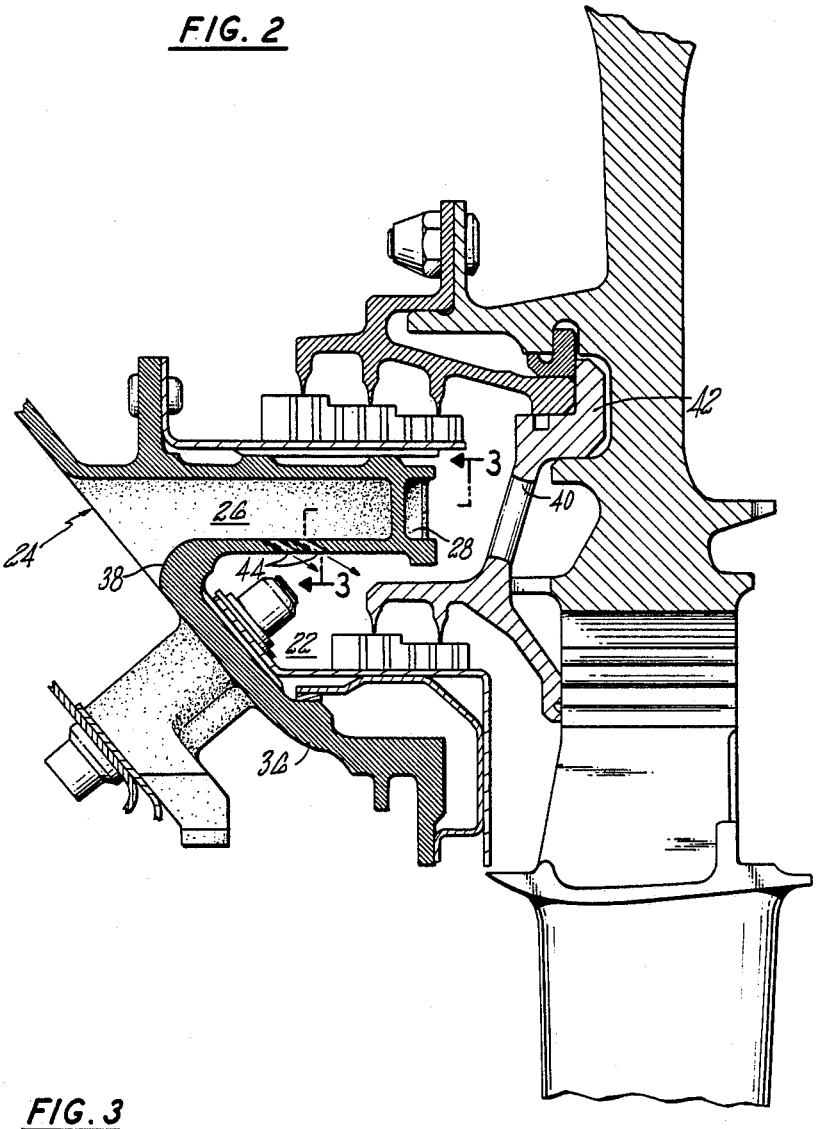
FIG. 2 is a view identical to FIG. 1 illustrating the details of the invention.
Figure 3:
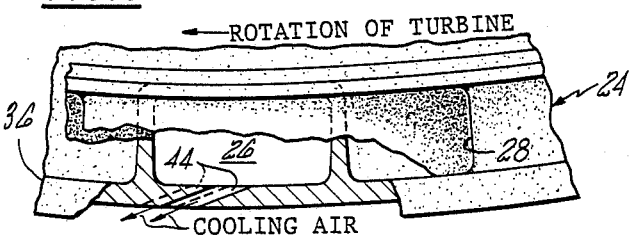
FIG. 3 is a partial view in section taken through lines 3—3 of FIG. 2.

Referring now to FIGS. 2 and 3, the improved TOBI 24 (like reference numerals in the drawings refer to like parts) comprises a generally annular housing 36 showing formed therein an annular passageway 26. As mentioned above, compressor discharge air is fed into the inlet 38 of the passageway 26 and discharges through a plurality of circumferentially spaced nozzles 28. The cooling air discharging out of nozzles 28 is in a direction coming out of the paper as viewed in FIG. 2 in the same rotational direction of the turbine rotor. This serves to direct the air tangentially to the turbine at a velocity substantially equal to the velocity of the turbine.

As will be appreciated from the foregoing description, the cooling air from TOBI 24 discharges into annular cavity 22 and passes through the opening 40 in the seal support member 42 and applied to the turbine for cooling purposes. Although not shown, the cooling air supplies the internal passages in the turbine blades for blade cooling.

The boundaries of the cavity 22 are defined by the housing 36 and the labyrinth seals 18 and 20. As mentioned earlier the seals have a propensity to leak and in a sense in the heretofore designs rob the cooling air discharging from nozzles 28, which as a consequence adversely affects the plume size, the pumping effect on the air and the overall temperature of the cooling air being delivered to the turbine.

In accordance with this invention, a plurality of apertures 44 are formed in the housing 36 of TOBI 24 to bypass the nozzles 28 by bleeding a portion of the air in annular passageway 26. The size, location and orientation of the apertures 44 are selected to bypass the amount of air that equals the amount of leakage air via the seals, and to direct the bypass air tangentially to the seal (as best seen in FIG. 3) so as to reduce the plume size, reduce the pumping effect and optimize the cooling effectiveness of the cooling air temperature.

Although this invention has been shown and described with respect to detailed embodiments thereof, it will be understood by those skilled in the art that various changes in form and detail thereof may be made without departing from the spirit and scope of the claimed invention.

We claim:

1. For a gas turbine engine having a turbine and a source of cooling air for cooling said turbine, TOBI means for directing said cooling air tangentially relative to said turbine, said TOBI means including an housing having an annular passageway, a plurality of circumferentially spaced nozzles in said housing at one end of said passageway and adjacent said turbine, an inlet in said passageway for leading cooling air from said source through said passageway to said nozzles for flowing cooling air into a cavity defined by said turbine and said housing, sealing means between said turbine and said housing for preventing the leakage of air from said cavity, said sealing means having a continuous amount of leakage from said cavity, means for reducing the size of the plume of the cooling air stream ejected from said nozzles and optimize the cooling of said cooling air, said means including a plurality of apertures formed in said housing for communicating with said annular passageway for bypassing a portion of said cooling air and directing it adjacent said sealing means and said plurality of apertures being oriented relative to said housing to impart a tangential velocity to the cooling air discharging therefrom to equal in magnitude and direction the tangential velocity of the cooling air discharging from said nozzles in said TOBI.

2. For a gas turbine engine as in claim 1 wherein said sealing means is a labyrinth seal.

3. For a gas turbine engine as in claim 1 wherein said turbine includes a disk rotating about an axis of rotation, a pair of sealing elements secured to said disk and extending in said cavity and sandwiching the nozzles of said TOBI, a pair of mating shrouds one for each of said pair of sealing elements cooperating therewith defining a seal, and said cooling air being directed to said sealing element, farthest away from said axis of rotation.

* * * * *